US012778217B1

(12) United States Patent
Mulcahy

(10) Patent No.: US 12,778,217 B1
(45) Date of Patent: Nov. 3, 2026

(54) ATHLETIC SHIRT WITH CONCEALED RETENTION BAND AND BACK GATHER

(71) Applicant: Cali Opi Athletica LLC, Odessa, FL (US)

(72) Inventor: Kayla Mulcahy, Odessa, FL (US)

(73) Assignee: Cali Opi Athletica LLC, Odessa, FL (US)

( * ) Notice: Subject to any disclaimer, the term of this patent is extended or adjusted under 35 U.S.C. 154(b) by 0 days.

(21) Appl. No.: 19/310,411

(22) Filed: Aug. 26, 2025

(51) Int. Cl.
*A41D 1/22* (2018.01)

(52) U.S. Cl.
CPC ..... *A41D 1/22* (2013.01)

(58) Field of Classification Search
CPC ..... A41D 3/08; A41D 3/005; A41D 2200/10; A41D 13/1245; A41D 13/0017; A41D 1/13; A41D 1/18; A41D 1/22; A41B 1/00; A41B 1/08
See application file for complete search history.

(56) References Cited

U.S. PATENT DOCUMENTS 1,112,387 A 9/1914 Schneer
1,226,654 A 5/1917 Gordon
1,786,105 A 12/1930 Clark
2,418,774 A 4/1947 Katz
5,720,044 A * 2/1998 Robinson ..... A41B 1/00 2/77
10,925,328 B1 * 2/2021 Diskin ..... A41D 1/04

* cited by examiner

*Primary Examiner* — Katherine M Moran
(74) *Attorney, Agent, or Firm* — Anton J. Hopen; Trenam Law

(57) ABSTRACT

An upper-body garment includes a front panel, a back panel, and an internal retention structure that maintains rear hem coverage while preserving an untucked anterior appearance. A front drape terminates in a scalloped hem. A continuous anterior retention loop is formed integrally from the back panel by cutlines that isolate an elongated strip whose ends remain attached within left and right side regions; the strip is turned forward to the anterior interior to cooperate with the front panel and define a wearer-facing loop opening. A posterior fabric gather, produced by rejoining back-panel edges or sewing darts, reduces the relaxed posterior hem span so the rear lower edge remains in abutment with the waist or hips during movement. Methods include retrofitting generic shirts and constructing from pre-designed panels that fold the integral loop flap forward, enabling zero-waste implementations. No separately affixed strap or belt is required.

8 Claims, 11 Drawing Sheets

ATHLETIC SHIRT WITH CONCEALED RETENTION BAND AND BACK GATHER

BACKGROUND OF THE INVENTION

Field of the Invention

This invention relates to wearing apparel, and more particularly to upper-body garments such as shirts, blouses, or jackets that include an internal structure for retaining the back hem of the garment in place. Specifically, the invention pertains to garments having an interior retention band that holds a gathered rear hem against the wearer's back while leaving the front hem free to drape normally.

Brief Description of the Prior Art

Shirts and similar upper-body garments have a tendency to shift and ride up during wear, especially at the back. When a person raises their arms or bends, the back of a typical shirt can untuck or climb upward, often exposing the lower back or midriff. Even a properly tucked shirt may come untucked with movement.

This issue is not only an aesthetic concern, disrupting a neat appearance, but can also lead to discomfort or exposure of skin. For untucked-style garments, the problem is more pronounced: the back hem can creep upward, causing the wearer to frequently pull the shirt down or risk exposing the lower back. There is a need for garments that maintain rear coverage and "stay down" at the back without requiring the front to be tucked in or constrained.

Various approaches have been attempted over the years to address shirt ride-up and untucking. One common solution has been external accessories such as shirt stays or straps. For example, elastic shirt garters attach to the shirt tail and either to the wearer's socks or around the legs, pulling the shirt taut downward. Another device is a shirt stay belt, which acts as an elastic belt around the shirt's waist and is hidden under the pants to keep the shirt tucked. These solutions, however, involve separate accessories that can be cumbersome, uncomfortable, or embarrassing to use, and they are designed primarily to keep a tucked shirt in place rather than allowing an untucked front. Some modern garments include silicon or rubber gripper elements at the hem (often used in athletic wear like cycling jerseys) to prevent ride-up. For instance, a cycling jersey may have a drop-tail hem with silicone grippers to keep the back in place. While effective in specific contexts, such grippers provide limited tension and are not commonly found in everyday shirts or blouses intended to be worn untucked.

Notably, the challenge of a "stay-down" shirt has been recognized in prior art. As early as the 1910s and 1920s, inventors proposed integrating elastic bands into shirts to secure the shirttail. U.S. Pat. No. 1,226,654 to Gordon (1917) disclosed a boy's blouse with a short elastic band located along the back hem, replacing the bottom button and buttonhole to make the bottom of the shirt fit snugly. This effectively cinched the back of the shirt at the waist. U.S. Pat. No. 1,112,387 to Schneer (1914) similarly taught a boy's blouse with a detachable elastic strap connected to the back hem with buttons, which could be adjusted or removed for washing. Schneer's elastic strap gave the bottom of the shirt a fitted effect. These early designs were precursors to later "shirt retention" concepts, but they were limited to elastic implementations and primarily aimed at children's garments.

Another prior development is Joseph H. Clark's "stay-down shirt" (U.S. Pat. No. 1,786,105, 1930). Clark's design made use of an internal elastic band at the waist of the shirt to engage the wearer's body and hold the lower shirt portion in place. In Clark's primary embodiment, the elastic band was anchored inside the shirt around the waistline. The back panel of the shirt was gathered (pleated) so that it was narrower than the relaxed length of the elastic across the back. This gathering allowed the elastic band to stretch when the wearer moved without tearing away from the fabric. Importantly, Clark left the front of the shirt ungathered so that, when worn, the front appeared flat and like a standard shirt. Thus, Clark recognized that only the back portion of the shirt should stretch, while the front remained unaffected, preserving a normal appearance.

Clark's shirt could be configured in two ways. In one version, the elastic band was effectively continuous around the waist: front flaps and a tailpiece were provided such that when the shirt's lowest button was fastened, the band encircled the entire waist inside the shirt. In that configuration, the band snugly engaged the body without binding, and only the back part of the band would stretch (the front portion of the band, if any, remained slack below the abdomen). To avoid bunching the shirt front, Clark taught that the band should extend only at the back; if the front flaps were omitted (so the band did not run through the front), he suggested making the band wider at the back for better grip.

Clark's second embodiment introduced an adjustable two-piece band: two elastic strips were attached at the waist on each side of the shirt (extending from the front towards the back) and left separated at the center back, where their ends were connected by strings or laces. The strings could be drawn together and tied, allowing the wearer to adjust the tension of the elastic strips. In effect, Clark provided a laced adjustment at the back, pulling the two elastic side-band pieces snug. In both versions, the elastic was hidden on the inside of the shirt, and only the back of the shirt was gathered or stretchable.

Clark's designs successfully kept the shirt "stay-down" at the back and sides; however, they also effectively cinched the shirt at the waist. The first version encircled the waist (which could potentially constrict the front unless carefully fitted), and the second version still involved elastic extending around each side of the torso to the front. In other words, Clark's retention structure was not limited strictly to the back panel-his elastic bands went around the wearer's sides (and even met at the front in the first version). While Clark emphasized preventing front bunching, his solution still operated at the waist circumference of the shirt.

Subsequent innovations built on similar ideas. For example, U.S. Pat. No. 2,418,774 to Katz (1947) disclosed a "non-blousy" shirt with an elastic belt encircling the entire waist to prevent ride-up. Katz's shirt had a stylized cut: the front shirttail was extended in a V-shape below the waist, while the back hem was cut higher (in an inverted V) above the elastic belt. The elastic was sewn around the entire bottom circumference of the shirt, with the front fabric extending below it, so that when tucked in, the elastic sat below the pant waistline invisibly. This design kept the shirt taut and in place, but again at the cost of a continuous elastic waistband on the shirt. It essentially created a built-in elastic girdle around the waist of the shirt, which is effective for keeping a shirt tucked but not suitable for an untucked style.

The prior art demonstrates a longstanding desire to keep shirt tails from riding up. Elastic bands or straps placed at the shirt's lower back or waist have been used in various forms (detachable straps, sewn-in elastic, adjustable laces) to hold shirts down. However, none of the prior solutions specifically addresses a garment designed to be worn with the front hem untucked and draped, while only the back hem is secured in place. Clark's stay-down shirt came close by allowing the front to remain flat and non-gathered, but his implementations still engaged portions of the shirt's sides or front (either via a full belt or side elastic strips).

Moreover, Clark's design introduced complexity (e.g., back gathers, lacing mechanism) that may not be ideal for modern garments. There remains a need for a simpler, more focused approach: an internal retention mechanism confined to the back hem of the garment that keeps the back down during movement, without constricting or altering the front of the garment. The present invention fulfills this need, enabling a shirt or other top to maintain rear coverage (avoiding ride-up) while preserving an untucked, free-hanging front appearance.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The present invention provides an upper-body garment that integrates a series of interrelated structural features designed to address the long-standing problem of shirt ride-up and rear hem displacement during wear. In particular, the invention provides a garment having a front panel and a back panel joined at left and right side regions, in which the back panel contributes material that is transformed into a continuous anterior retention loop, the back panel is simultaneously modified to include a posterior fabric gather that reduces the relaxed posterior width, and the front panel is modified to include a draped section terminating in a scalloped hem that conceals the loop while preserving a natural untucked aesthetic. These features operate together to create an asymmetric tension system: the anterior remains free of circumferential compression while the posterior is constrained to maintain continuous abutment with the wearer's lower back or hips.

A key aspect of the invention is the anterior retention loop. Unlike prior devices that relied upon elastic straps, sewn-in waistbands, or belts that encircled the wearer's body, the present invention forms the loop integrally and continuously from the back panel of the garment itself. In retrofit embodiments, cutlines are executed in the back panel to isolate an elongated strip of fabric. The strip remains attached at its two lateral ends within the left and right side regions while being freed along its length. This continuous strip is then swung forward, through openings or pass-throughs in the side regions, into the anterior interior of the shirt. There it lies against the inside surface of the front panel and cooperates with the front panel to define a wearer-facing loop opening. The loop therefore originates from the back panel, but its functional position is on the anterior interior, where it spans horizontally across the waist region. Because the loop remains integral and continuous with the garment body, it does not rely on separately affixed components. It maintains strength through the side-region attachments, and its geometry is carefully dimensioned: its vertical width is preferably between 10 and 50 millimeters, its lateral span typically between 60 and 85 percent of the distance between the anterior side seam apexes, and its effective tension calibrated to engage the anterior waist without compressing the abdomen. In panel-based embodiments, the loop is drafted as a flap extension of the back panel itself and swung forward prior to side-region closure, producing the same functional loop and opening without cutting waste fabric.

Complementing the loop is the posterior fabric gather. In retrofit embodiments, the back panel is cut along left and right gather cutlines, and optionally along a top gather cutline, to define edges that are rejoined by overlap, butt-join, or dart sewing. This removes 5 to 20 percent of the original posterior width, thereby reducing the relaxed hem span and creating a scrunch, or ruche, that shortens the back of the shirt relative to the front. In panel-based embodiments, the gather is established by incorporating dart legs, eased-in length, or drafted overlaps directly into the back panel pattern, eliminating the need to trim or discard fabric. The gather concentrates retention forces at the mid-spine region, holding the posterior hem in abutment with the waist or hips throughout bending, stretching, or reaching movements. The scrunch appearance is subtle when viewed externally but provides a functional reduction in rear hem slack that distinguishes the garment from prior art.

The third coordinated element is the front drape with scalloped hem. In retrofit embodiments, the unmodified anterior hemline is replaced by a scallop hem cutline that curves upward or downward in a smooth arcuate contour. This produces a front drape panel that hangs free over the abdomen and terminates in the scalloped hem. The scallop depth, defined by the ratio of scallop height to overall garment height, is preferably between 0.18 and 0.40, and its curvature is dimensioned so that the drape conceals the anterior retention loop in the donned state. In panel-based embodiments, the scalloped contour is drafted directly into the pattern, eliminating trimming waste. In either case, the front drape is unconstrained: it hangs naturally, provides aesthetic variation, and ensures that the functional loop structure remains hidden from external view.

The cooperation of these three features—anterior retention loop formed integrally from the back panel and swung forward, posterior fabric gather that reduces rear width, and scalloped front drape that conceals the loop—creates a unique apparel construction. The loop engages the anterior waist to anchor the garment, the gather ensures that the rear hem stays in contact with the body during motion, and the scalloped drape preserves an untucked appearance without abdominal compression. The garment therefore achieves a dual objective: it solves the practical problem of back hem ride-up while maintaining style and comfort. The interior loop is invisible externally, the posterior gather is subtle, and the scalloped drape appears as a fashion detail rather than a functional necessity.

The invention is adaptable to multiple modes of manufacture. In retrofit systems, existing shirts having an unmodified horizontal hem can be transformed by executing cut-lines for the loop, the gather, and the scallop, followed by rejoining seams and finishing edges. In panel-based, zero-waste systems, the back panel is drafted with an integral loop flap and darts for the gather, while the front panel is drafted with a scalloped contour, so that the inventive features emerge as part of the initial cutting and sewing sequence without discarding fabric. In either case, the anterior retention loop remains continuous and integral, the posterior gather shortens the rear width, and the scalloped front drape conceals the loop and maintains a free-hanging appearance.

Accordingly, the invention provides a garment construction that departs fundamentally from prior art solutions such as Clark's stay-down shirt, which used elastic encircling bands, or Katz's full-waist elastic structures. By forming the retention loop integrally from the back panel and swinging it forward, by implementing a posterior gather rather than circumferential elastic, and by concealing the structure under a scalloped front drape, the invention offers a unique balance of functional stability and aesthetic presentation. These coordinated features together define the scope of the invention and form the basis for the appended claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
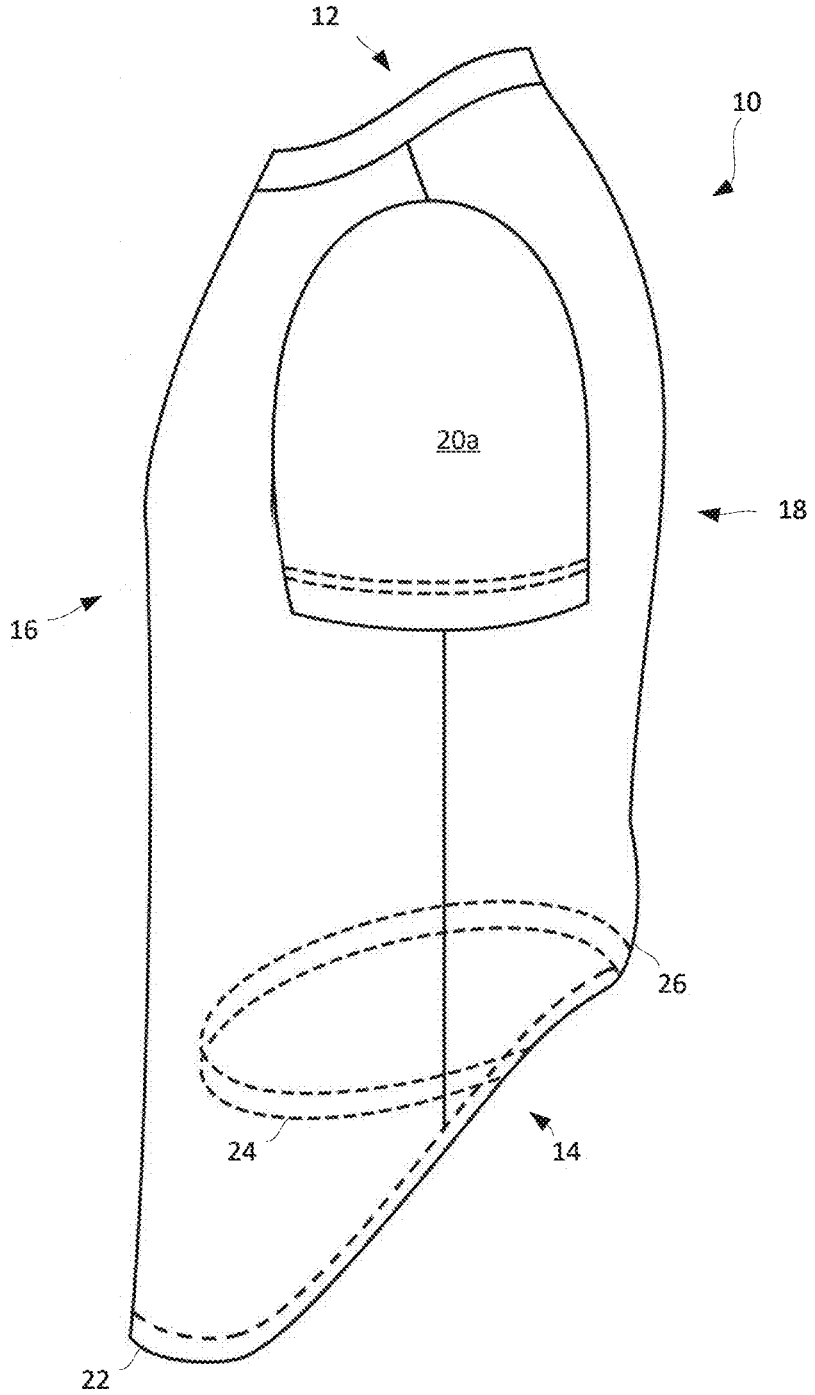
FIG. 1 is a side-elevated, partially sectional view of an embodiment of the invention.

FIG. 1 is a side-elevated, partially sectional view of one embodiment of the invention. This drawing illustrates the garment from a side perspective, with a portion of the structure cut away to reveal internal features. In this view, one can see the anterior shirt face 16 and the posterior shirt face 18 of a modified athletic shirt 10. A front drape panel 22 hangs from the front of the shirt, and the partial section reveals an anterior retention band 24 formed from a strip of the back panel swung forward into the anterior interior. The posterior side of the shirt is gathered into a fabric scrunch or "gather" 26 along the center back, which is visible from this side perspective due to the cutaway. Also visible are one of the sleeves 20*a*, the neck opening 12 at the top, and the body opening 14 at the bottom of the shirt. This figure provides an overall understanding of the garment's configuration and how the new components (the front drape, retention band, and back scrunch) are arranged in the modified shirt.

Figure 2:
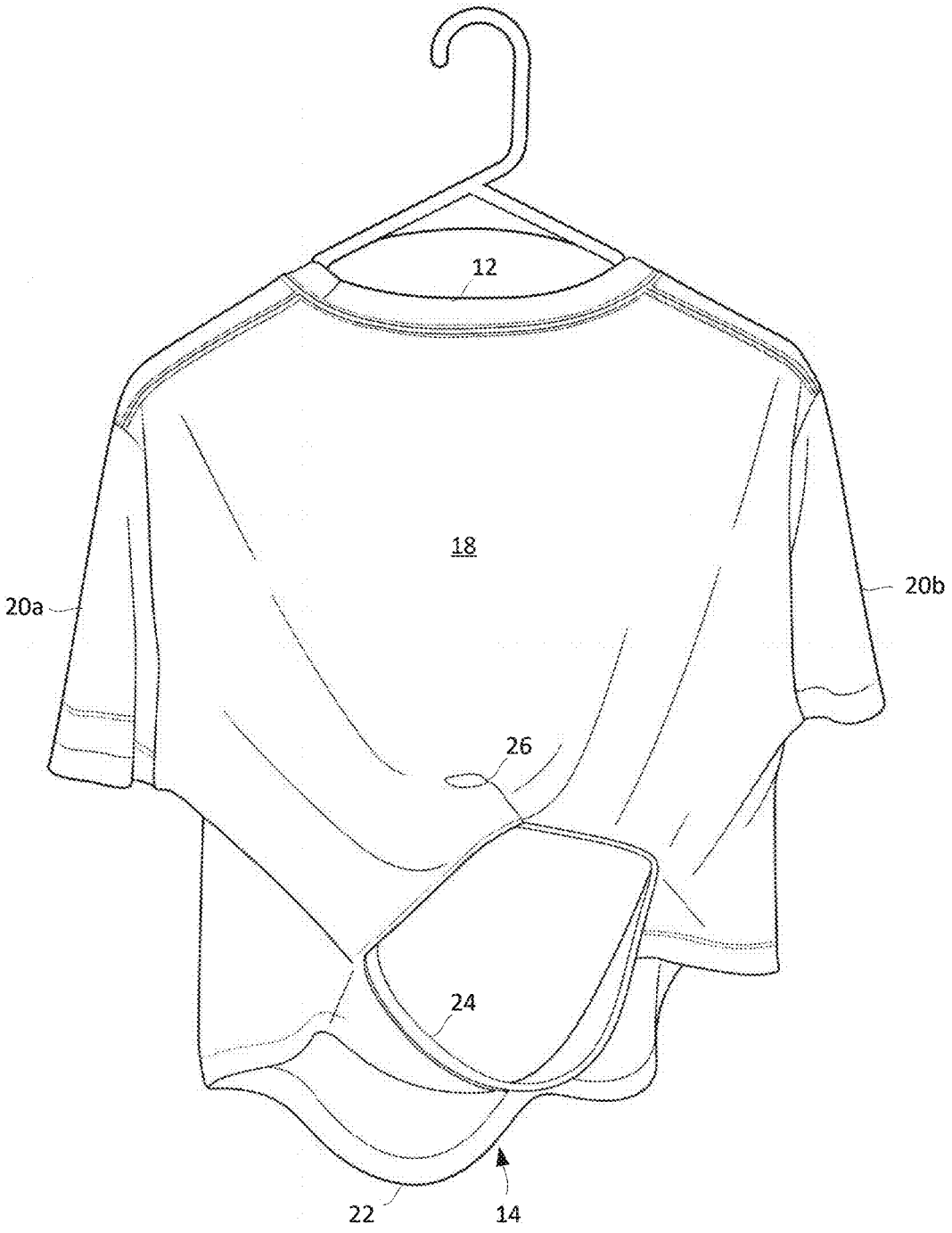
FIG. 2 is an elevated rear view of an embodiment of the invention.

FIG. 2 is an elevated rear view of the embodiment of the invention, showing the garment from behind. From this rear perspective, the posterior shirt face 18 is fully visible along with both sleeves (20*a* and 20*b*) extending outward. The neck opening 12 can be seen at the top of the shirt, and the body opening 14 at the bottom. A notable feature in this view is the posterior gather 26 running vertically along the back of the shirt. The gather appears as a bunched section of fabric in the center of the back, which is a result of the construction or modifications made to the shirt. The front drape 22 and the anterior retention band 24 are on the front side of the shirt and thus mostly hidden from view in this rear illustration. Overall, FIG. 2 shows that from the back the modified garment maintains a relatively normal appearance with the exception of the subtle gathered fabric at the center back that provides a snugger fit.

Figure 3:
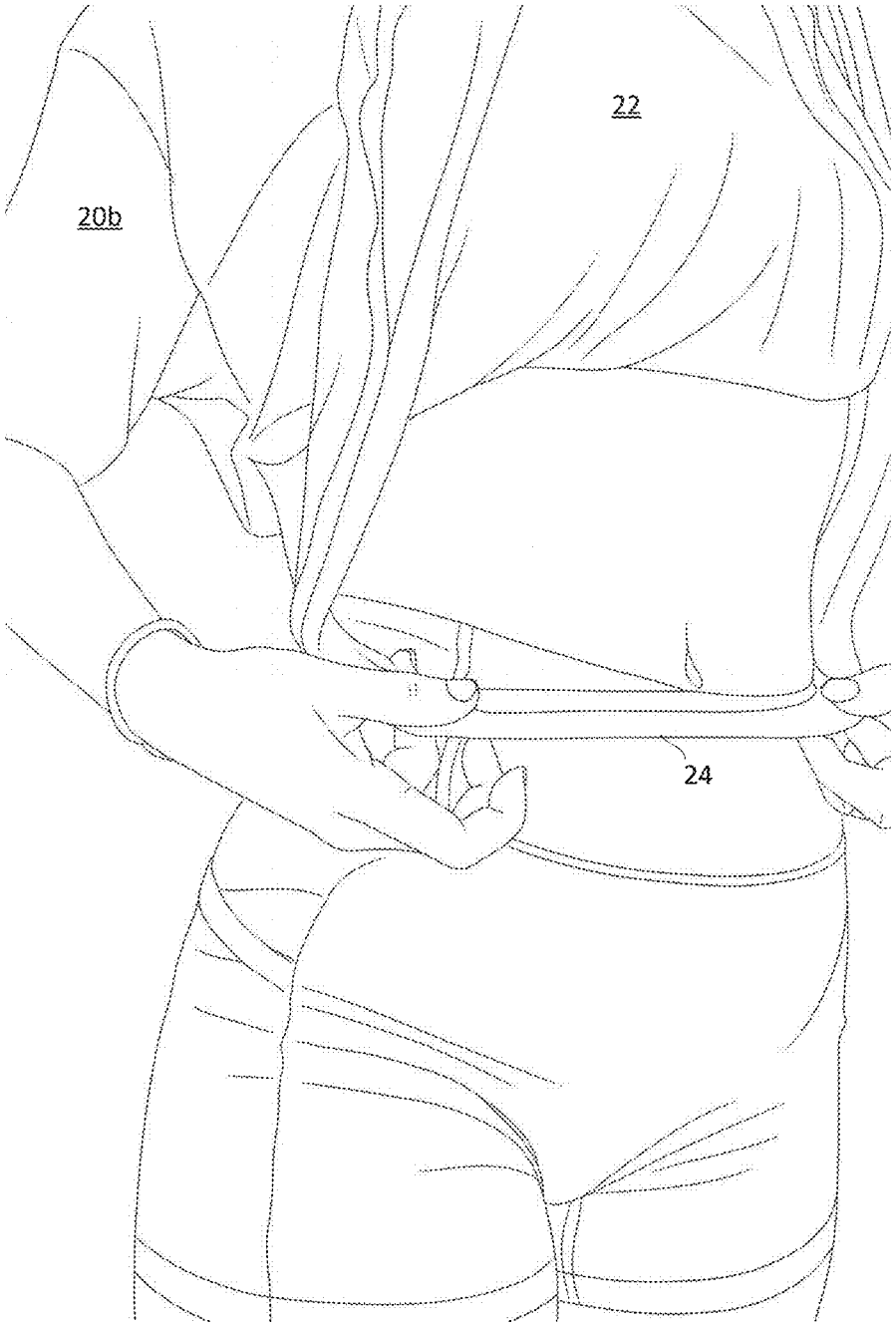
FIG. 3 is a view of an embodiment of the invention as worn by a user with the front drape pulled up to reveal an anterior retention band.

FIG. 3 is a view of an embodiment of the invention as worn by a user, with the front drape pulled up to reveal an anterior retention band. In this figure, a person is wearing the modified shirt, and the front drape panel 22 that normally hangs over the front has been lifted upward. Lifting the drape exposes the anterior retention band 24 that originates from the back panel, swung forward across the interior, and lies against the wearer's anterior waist. This retention band is integrated into the shirt and is designed to encircle the front of the torso, providing support or tension. The figure demonstrates how the retention band is normally concealed by the draped front fabric, yet it can be accessed by lifting the drape. The user's posture and the lifted drape make the band clearly visible, showing its position and width. This view highlights the relationship between the drape and the band: the drape provides coverage and aesthetic styling, while underneath it the retention band serves a functional role. The rest of the shirt can be seen conforming to the user's body, and although not the focus of this figure, the back of the garment would include the gather feature (not visible here). FIG. 3 thus provides insight into how the front panel of the shirt can be moved to reveal the supportive structure (the retention band) that is otherwise hidden during normal wear.

Figure 4:
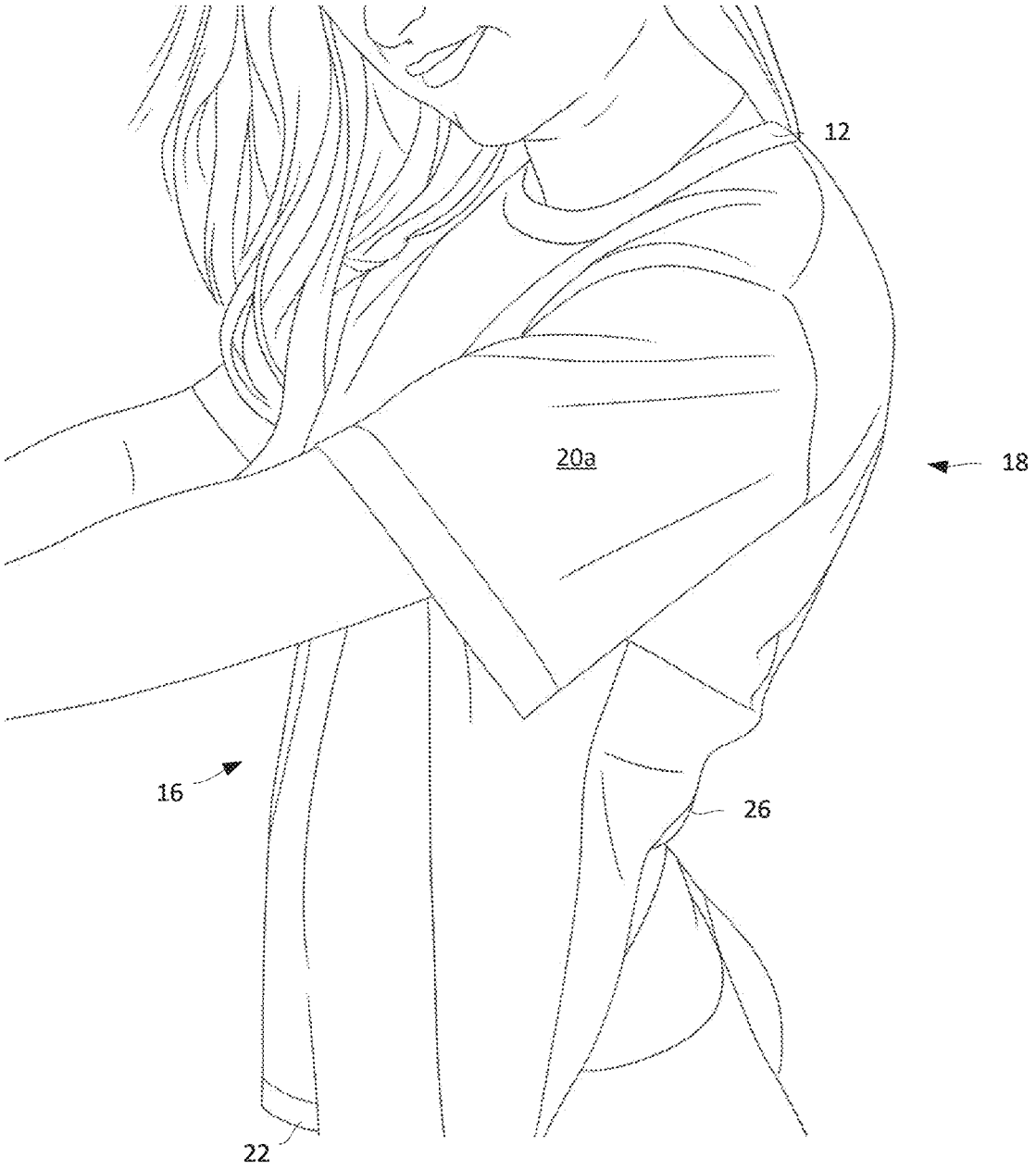
FIG. 4 is a side view of an embodiment of the invention as worn by a user.

FIG. 4 is a side view of an embodiment of the invention as worn by a user. In this illustration, the person is standing sideways, allowing a clear profile view of the modified shirt on the body. From this side angle, the way the shirt drapes and fits can be observed. The front drape 22 is shown hanging naturally over the wearer's front midsection, creating a loose, flowing appearance at the belly or waist area. Because the drape panel falls over the front, the anterior retention band 24, derived integrally from the back panel and swung forward, is not directly visible; however, the band's presence ensures that the shirt remains fitted around the wearer's waist behind the drape. On the backside of the shirt, the effect of the posterior gather 26 is visible along the spine area. The gather joins the fabric in the back, causing the shirt to hug the lower back more tightly and providing a contoured fit. The side view also shows one sleeve 20*a* and the general outline of the shirt's neck and bottom openings, indicating how the garment aligns with the wearer's torso. Overall, FIG. 4 highlights the profile of the garment, demonstrating how the front drape conceals the supportive band while the back gather pulls the shirt snugly against the wearer's back, resulting in a form-fitting yet flexible silhouette from the side.

Figure 5:
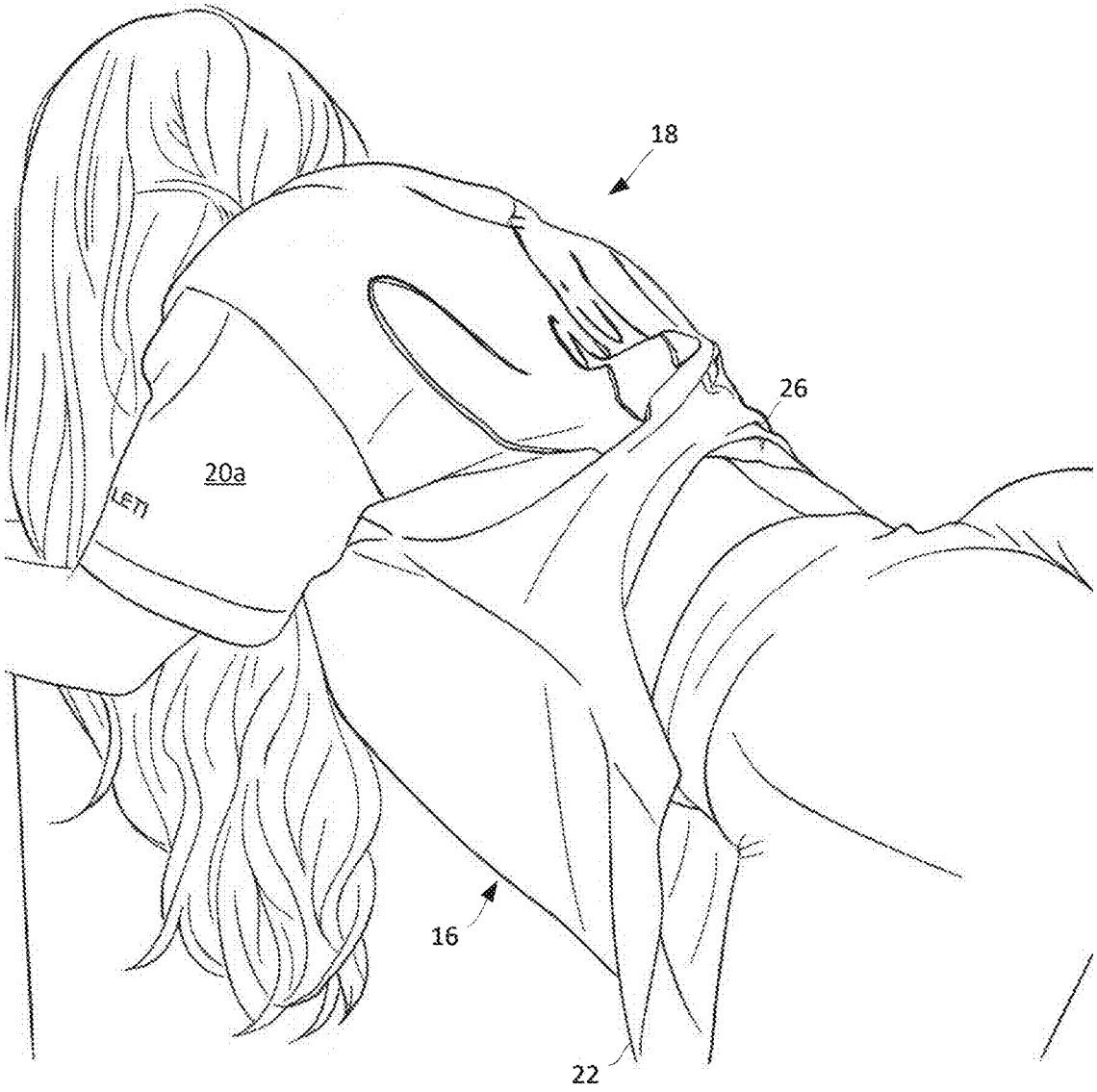
FIG. 5 is a rear view of an embodiment of the invention as worn by a user engaged in exercise.

FIG. 5 is a rear view of an embodiment of the invention as worn by a user engaged in exercise. In this figure, the person wearing the shirt is in motion or adopting a pose associated with physical activity, providing a dynamic perspective on how the garment performs. From behind, one can see the entire back of the shirt as the user moves. The posterior gather 26 in the center back remains evident, even as the fabric stretches or shifts with the user's activity. The gather feature helps keep the shirt aligned and close to the body, preventing excessive loosening or flapping of material during movement. Left sleeve (indicated by 20*a* on the left arm, with the right sleeve 20*b* on the far side) is visible in this active pose, demonstrating that the shirt stays in place around the shoulders and arms without riding up. The front drape 22 may not be directly visible from the rear, but its effect can be inferred; even as the user exercises, the front panel would continue to cover the retention band and provide freedom of movement in the front. FIG. 5 thus shows that the constructed or modified shirt maintains its intended fit and functionality when the wearer is active. The garment clings appropriately at the back due to the scrunched section and remains secure around the waist thanks to the hidden retention band, ensuring that even during exercise the shirt does not shift undesirably. This view emphasizes the stability and comfort of the design under conditions of motion.

Figure 6:
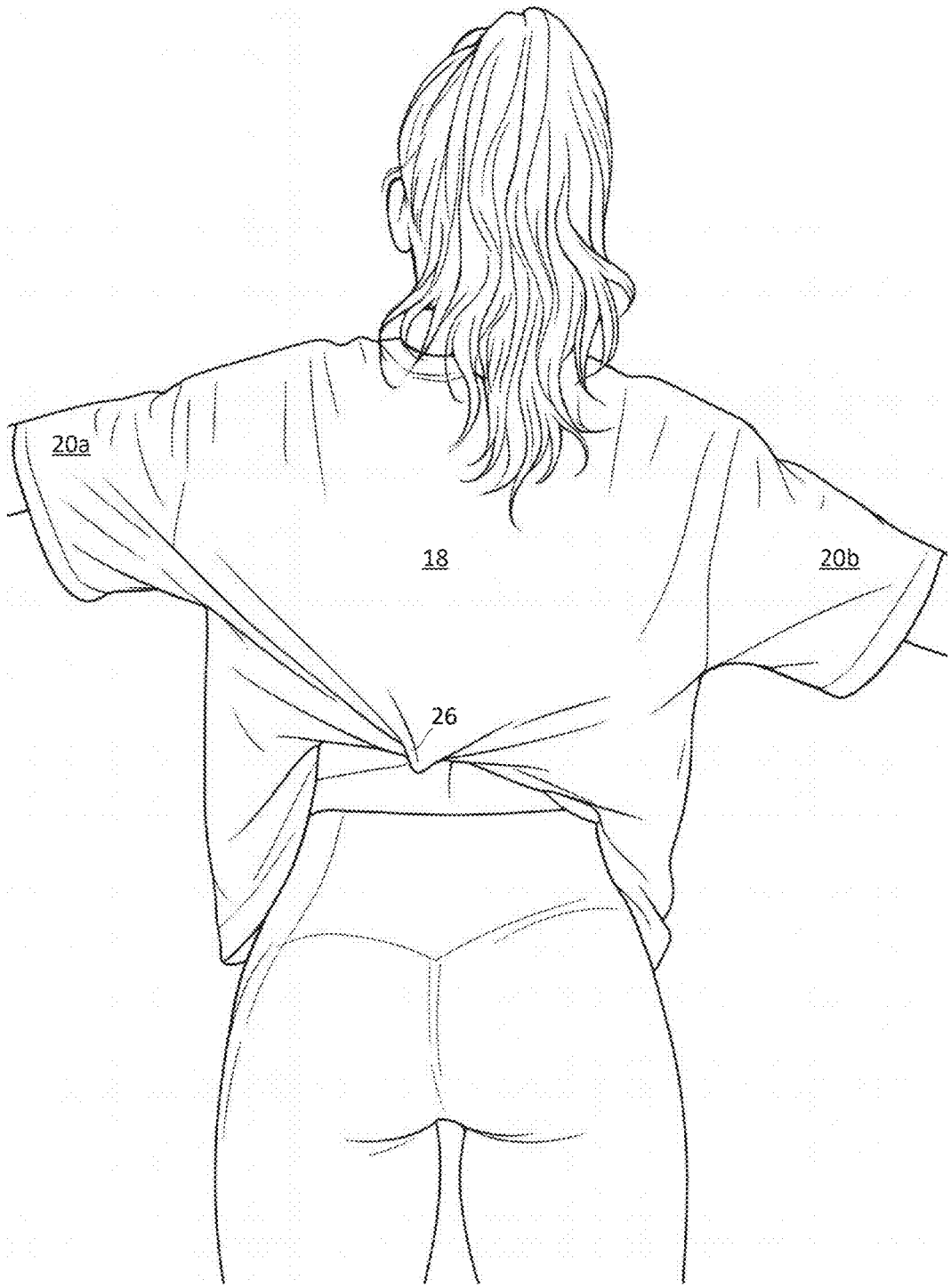
FIG. 6 is a rear view of an embodiment of the invention as worn by a standing user.

FIG. 6 is a rear view of an embodiment of the invention as worn by a standing user. Here, the person is standing upright in a relaxed, normal posture, and the back of the garment is displayed from top to bottom. Similar to FIG. 2, this view highlights how the shirt appears from behind during regular wear, but now on an actual user's body. The posterior shirt face 18 is smooth except for the intentional gathering at the posterior gather 26 along the center back. This gather section creates gentle folds or a scrunched appearance, which allows the shirt to conform to the curve of the user's lower back. The rest of the back panel lies comfortably against the body. Both the left and right sleeves (20*a* and 20*b*) are visible symmetrically on each side of the user, and the shoulder and upper back area of the shirt sits correctly around the wearer's form.

The neck opening of the shirt is seen at the top, fitting around the user's neck, and the lower edge (the hem) rests at the appropriate position on the wearer's waist. From this standing rear view, the modifications, such as the gather, blend into the shirt's silhouette, showing that the garment looks typical yet has enhanced fit. The front drape and retention band are on the opposite side of the user and do not appear in this view, but their presence is implied by the tailored way the shirt hugs the back. FIG. 6 thus presents the completed shirt in a normal wearing scenario, illustrating that from the outside back perspective, the shirt retains a neat appearance with improved fitting features that are not bulky or obvious.

Figure 7:
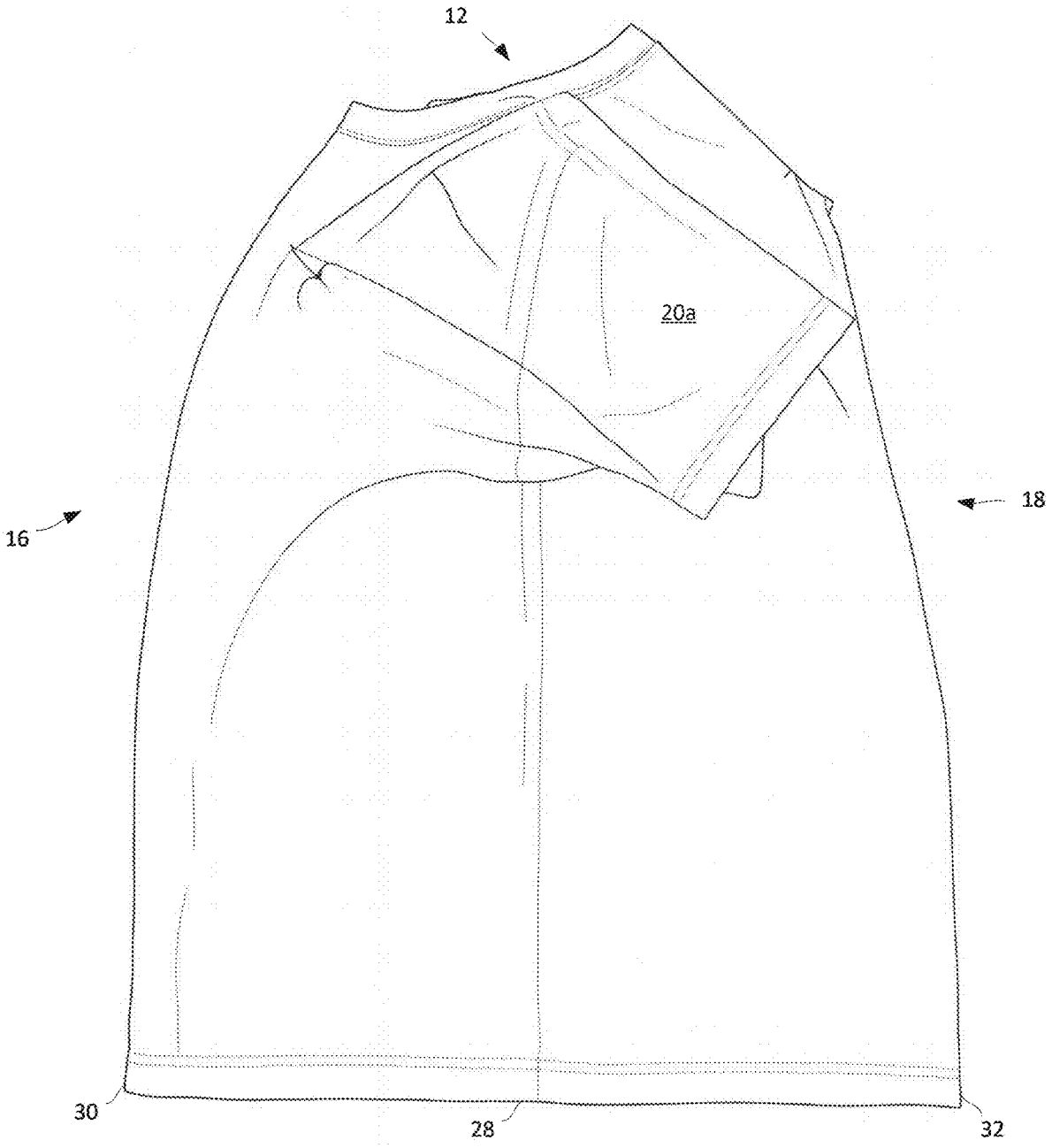
FIG. 7 is a top-down view of an athletic shirt laid flat on its side prior to modification by the invention.

FIG. 7 is a top, down view of an athletic shirt laid flat on its side prior to modification by the invention. This figure shows the starting garment in its unaltered, conventional form. The shirt 10 is spread out on a flat surface, oriented such that one side seam is positioned downward (hence "on its side"), allowing both the front and back of the shirt to be partially observable. The anterior shirt face 16 and the posterior shirt face 18 are indicated, representing the front and back panels of the unmodified shirt. The neck opening 12 is clearly visible at the top center, and one sleeve 20*a* extends to the side in this orientation (with the other sleeve underneath or not directly seen due to the side layout). Along the bottom of the shirt, the hem is intact and unaltered, labeled here as an unmodified horizontal hem 28. The front portion of that hem is identified as the unmodified anterior hemline 30, and the rear portion as the unmodified posterior hemline 32. In this state, the shirt has a continuous lower edge with no cuts or disruptions, and the fabric is smooth and unmanipulated. FIG. 7 essentially provides a baseline image of the garment before any inventive steps are applied, establishing the original shape and dimensions that will be transformed in subsequent steps.

Figure 8:
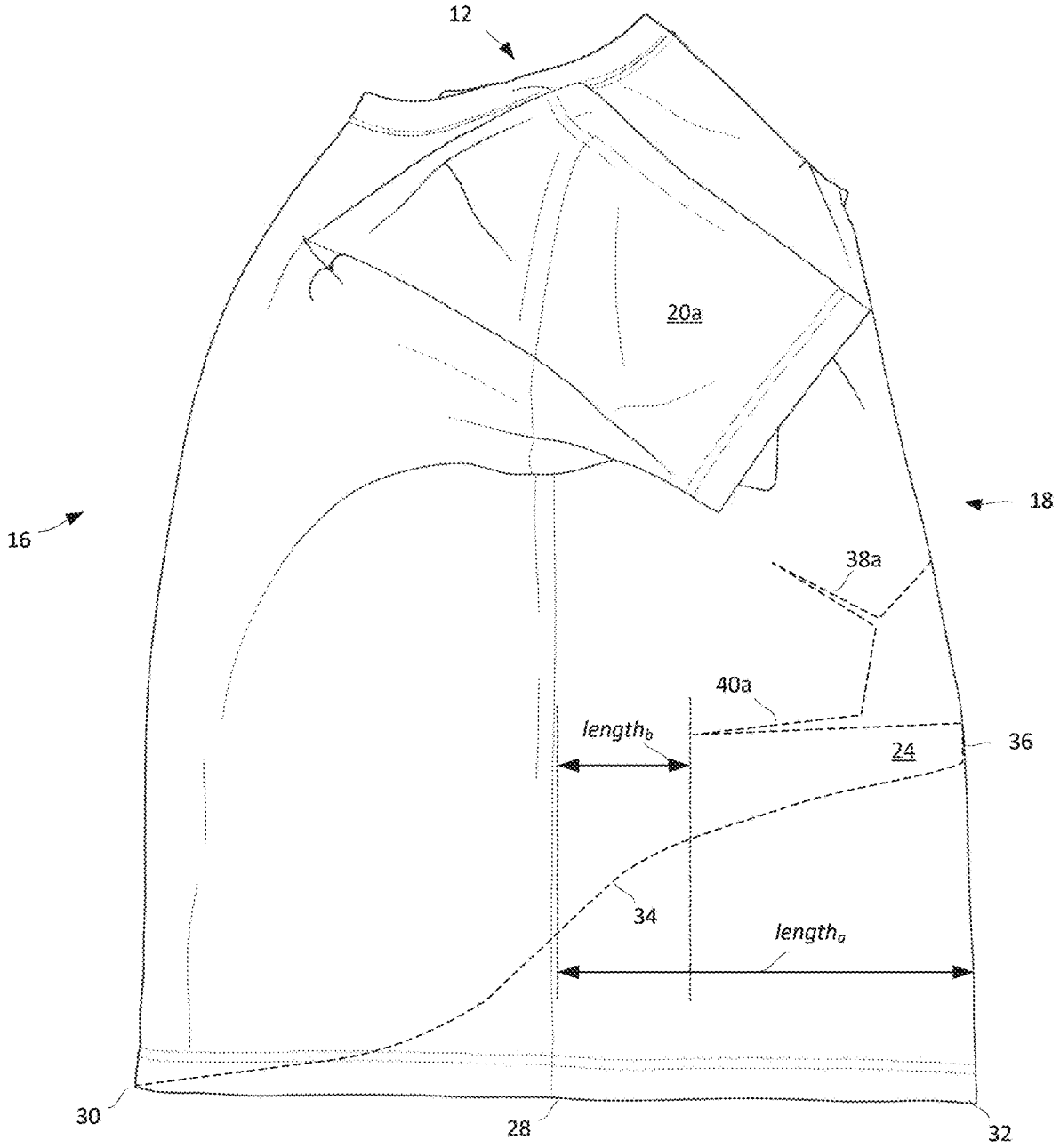
FIG. 8 is a top-down view of an athletic shirt laid flat on its side showing cut-lines and exemplary dimensions thereof.

FIG. 8 is a top-down view of the athletic shirt laid flat on its side (as in FIG. 7), but here it shows the cut-lines and exemplary dimensions for the modifications. In this illustration, various guide lines are drawn onto the shirt to indicate where the fabric will be cut and altered in order to create the invention's features. A scalloped hem cut line 34 is marked across the front lower portion of the shirt, curving upward in the middle, this line defines how the front hem will be reshaped into a scalloped edge for the front drape. The pattern for creating the anterior retention band is also outlined 36 on the back panel. The cut pattern for creating the anterior retention band is outlined 36 in the back panel, which after cutting is swung forward to form the loop at the anterior interior.

Near the upper back region of the shirt, a pair of short cut lines are drawn on either side of the center; these are the upper gather cut lines (38*a* on the left side of the back, and 38*b* on the right side). Similarly, near the lower front sides (toward the bottom of the shirt's front panel), lower retention band cut lines are marked (40*a* on the left, 40*b* on the right). The upper cut lines (38*a*, 38*b*) indicate where the material will be slit to allow the back fabric to be gathered (forming the gather), while the lower cut lines (40*a*, 40*b*) outline the sides of the strip of fabric that will form the retention band, separating it from the rest of the back panel except at the very sides. In addition to the cut markings, FIG. 8 provides exemplary dimensions labeled as length "a" and length "b." Length "a" represents the original lower hem measurement (for example, the radius or half-circumference of the bottom opening of the shirt), and length "b" represents the lateral depth of the cut for the retention band on the front (for instance, how far up from the hem the cut pattern 36 extends into the shirt, shown here as a percentage of some reference length). These dimensional indicators are included to give scale and guidance for performing the modifications. Length "b" is preferably about 35 percent of length "a" but may range between 0-50 percent. Overall, FIG. 8 maps out where and how the original shirt will be cut to introduce the front drape, the retention band, and the back gather features.

Figure 9:
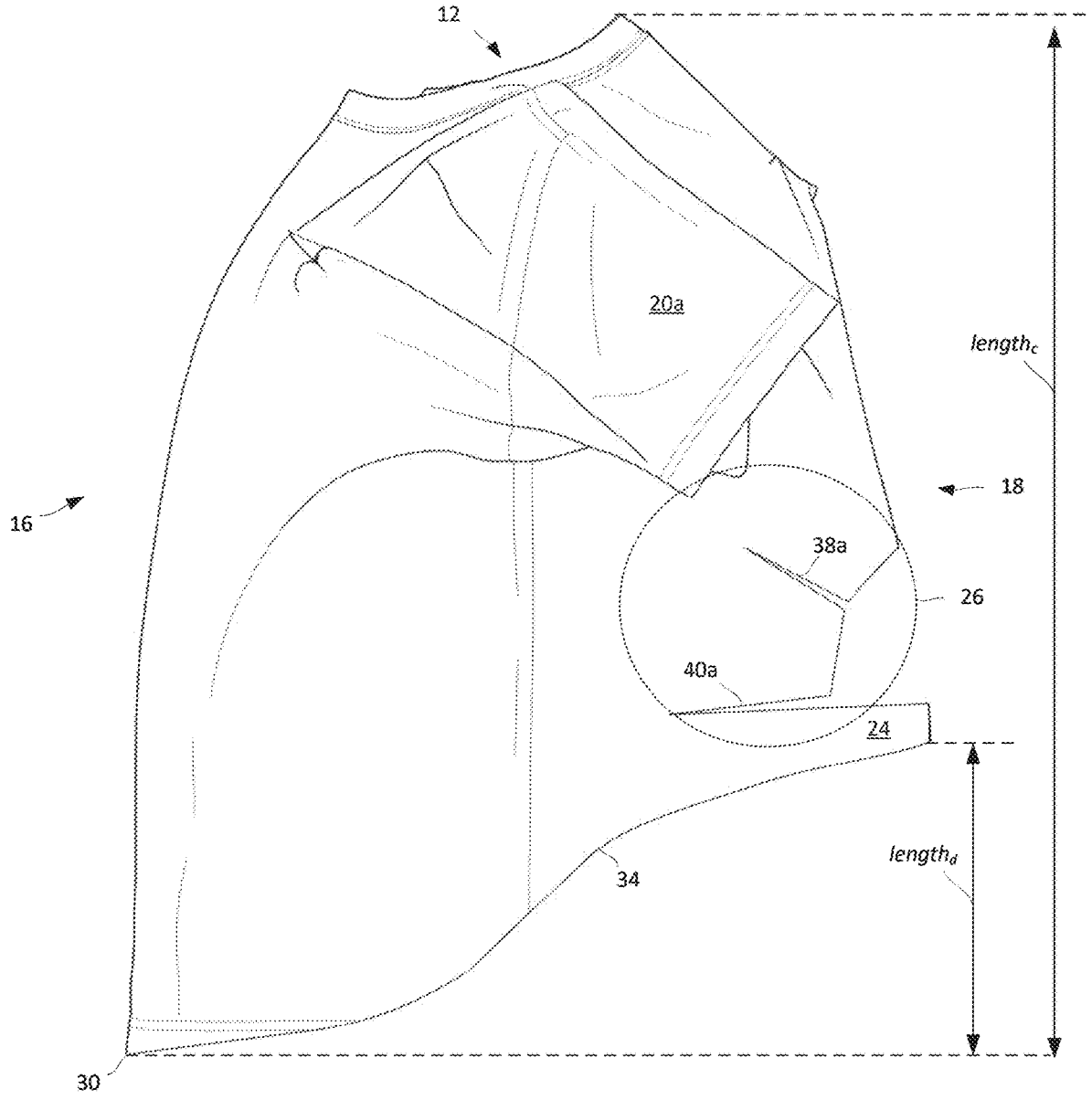
FIG. 9 is a top-down view of an athletic shirt laid flat on its side with cut material removed.

FIG. 9 is a top-down view of the athletic shirt laid flat on its side with the cut material removed, after the modifications outlined in FIG. 8 have been carried out. In this figure, the shirt now has several openings and detached sections as a result of the cutting process. Along the front lower edge, the fabric has been cut along the scalloped line 34, separating a portion of the front hem. This creates a front drape panel 22 that now has a curved, scalloped lower edge. The front drape panel remains attached to the shirt at its upper side, but its bottom is cut free in that scalloped shape, allowing it to function as a flap or drape over the front. Above this, the anterior retention band 24 is now visibly delineated as a horizontal strip of fabric originally cut from the back panel and swung forward to span across the interior front. The cuts along the pattern 36 and the lower sides (40*a*, 40*b*) have freed this band from the surrounding front fabric except at the very ends near the side seams.

Consequently, an opening 25 appears above and below the band, essentially a gap in the front of the shirt where material was removed to isolate the band. This opening is where the wearer's body will later pass when the shirt is donned, effectively turning the band into a loop that can snugly engage the wearer's waist. On the back side of the shirt, the upper gather cut lines (38*a*, 38*b*) have been executed, resulting in two slits or separations in the upper portion of the posterior shirt face 18. The fabric that was between those gather cut lines is now loose, creating what can be viewed as two small tabs or flaps on either side of the center back, these will later be brought together to form the gather 26.

The shirt in this state clearly shows the modification points: the front has a large cut-out region defining the drape and band, and the back has narrow cut openings for the gather feature. FIG. 9 also includes dimensional references labeled as length "c" and length "d." Length "c" indicates the overall height of the shirt from the original bottom hem to the neck opening, providing context for scale. Length "d" denotes the maximum height of the scallop cut into the front (essentially how far up the scalloped cut line 34 reaches from the original hemline, shown as a percentage of the shirt's height). These measurements illustrate the proportions of the alterations relative to the entire garment. In an embodiment, length "d" is approximately 30 percent of length "c" but may range between 10-50 percent in relative height. In summary, FIG. 9 depicts the shirt immediately after cutting: the front drape panel is separated with a scalloped edge, the retention band is cut free and an opening is created around it, and the back gather cuts are made, with all the excess material from these cuts removed from the garment.

Figure 10:
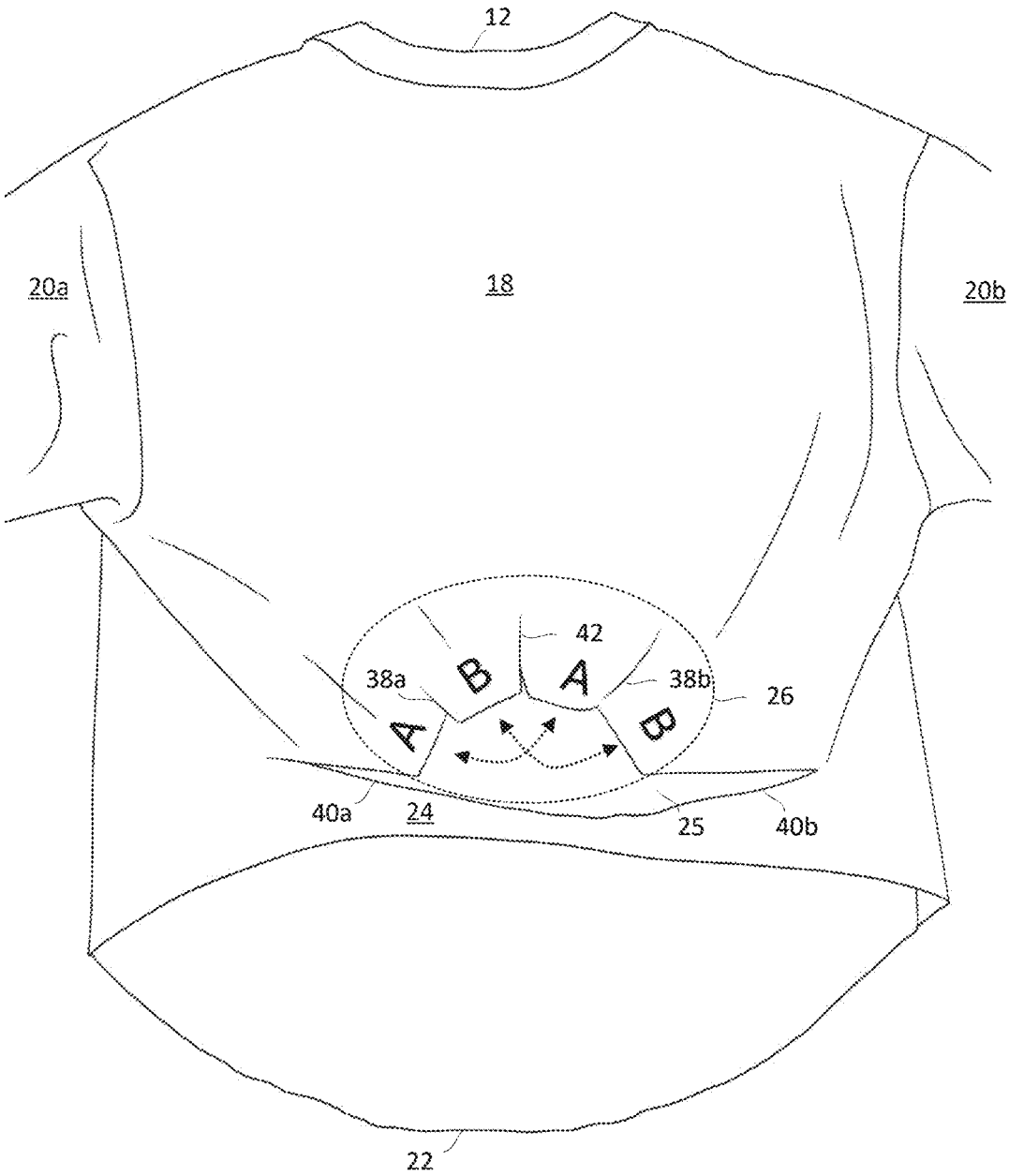
FIG. 10 is a top-down view of an athletic shirt laid flat on its anterior side showing two sets of fabric tabs before assembly.

FIG. 10 is a top-down view of the athletic shirt laid flat on its anterior side (front side up), showing two sets of fabric tabs before assembly. After the cutting steps (as seen in FIG. 9), the shirt now has various loose sections of fabric that need to be joined to complete the garment's transformation. In FIG. 10, the shirt is oriented with the front facing upward, allowing us to see how these loose sections are positioned prior to being sewn together.

There are two main sets of fabric tabs visible, one on the left side of the shirt and one on the right side, which are the results of the earlier cuts. Each set consists of an upper tab and a lower tab that will be joined. More specifically, on the left side of the shirt, an upper fabric tab created by the left gather cut 38*a* can be seen near the upper back area, and just below it, a lower fabric tab created by the left retention band cut 40*a* is present near the lower front side. Similarly, on the right side of the shirt, the upper tab from the right gather cut 38*b* and the lower tab from the right retention band cut 40*b* are visible. Top gather cut is denoted as 42. These tabs are essentially the free edges of material resulting from cutting the shirt: the gather cut tabs (38*a*, 38*b* and 42) come from the back panel and will eventually be pulled together to form the scrunched gather, and the retention band cut tabs (40*a*, 40*b*) are portions of the back panel that will be secured to integrate the retention band fully into the shirt's structure. The anterior retention band 24 itself is now a distinct strip cut from the back panel, swung forward across the anterior interior, and extending across the front, attached at its ends but otherwise separate from the front drape above and the lower front fabric below; its central opening 25 is apparent, showing where the band is isolated from the rest of the shirt. At this pre-assembly stage, nothing has been stitched yet, so the shirt appears disjointed: the front drape panel 22 is hanging loose at its bottom edge, the retention band 24 is cut free with gaps above and below it, and the back gather area has split edges. Tabs denoted "A" are stitched or affixed together as well as tabs denoted "B" to form gather 26. FIG. 10 captures this intermediate configuration, illustrating clearly the pieces (tabs and panels of fabric) that have been created by the modifications. This view sets the stage for the final assembly, where these loose tabs and sections will be sewn or otherwise joined to form the finished garment.

Figure 11:
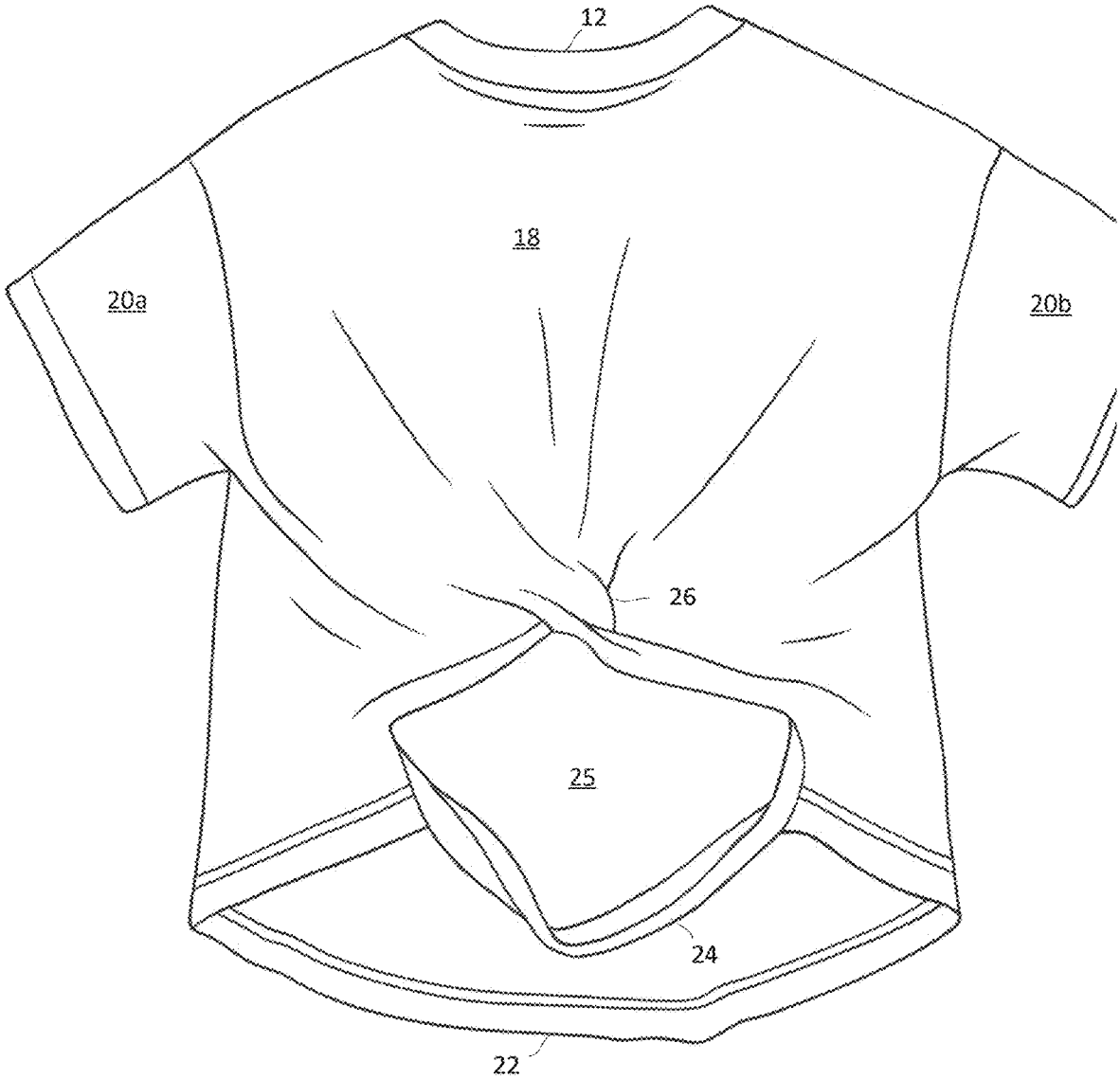
FIG. 11 is a top-down view of an athletic shirt laid flat on its anterior side showing the completed assembly.

FIG. 11 is a top-down view of the athletic shirt laid flat on its anterior side showing the completed assembly after all modifications. In this final illustration, the garment has been fully reassembled and finished according to the invention. With the front side of the shirt facing up, one can see that the previously loose sections have been secured in place, and the shirt now has an integrated structure. The anterior retention band 24, originally part of the back panel and swung forward, is now firmly incorporated across the front of the shirt at the waist area. Its ends are anchored, presumably by stitching, at the sides of the shirt, and it forms a loop with an opening 25 above it. This opening is where the wearer's body (and specifically the torso) will pass when putting the shirt on, allowing the retention band to sit snugly around the front of the waist like an internal belt.

Above the band, the front drape panel 22 with its scalloped hem is intact and attached at its top to the shirt, draping down over the front of the retention band. Now that assembly is complete, the drape panel overlaps and conceals the retention band, hanging freely with its curved lower edge for a stylish look. The lower portion of the shirt below the band has been rejoined as well, so the front opening is closed except for where the band resides. On the back side of the shirt (which is against the flat surface in this view and not directly visible), the fabric tabs from the gather cuts have been brought together and secured, forming the posterior gather 26. This means the back of the shirt now has a gathered, scrunched section in the center, achieved by the assembly of those cut edges, which pulls the back fabric in and gives it elasticity and form-fitting tension.

In FIG. 11, the presence of the gather 26 is implied by the prior steps and by slight tension lines observed at the sides. The neck opening 12 and sleeves (20*a*, 20*b*) are in their normal positions, indicating that the overall shirt maintains its original general shape and size. FIG. 11 thus presents the finished garment resulting from the invention's modification process. All the design features are now in place: the front drape provides coverage and aesthetic detail, the hidden retention band offers support and keeps the shirt in place around the waist, and the scrunched back (e.g., "gather") ensures a contoured fit. This completed assembly view confirms that the original athletic shirt has been successfully transformed into the new garment with the enhanced structure as described in the invention.

Manufacturing Embodiments

The manufacturing embodiments described herein enable industrial-scale implementation of the anterior retention loop 24, the posterior fabric gather 26, and the front drape 22 with scalloped hem, across both retrofit operations applied to existing inventory and purpose-designed production with pre-shaped panels. The processes are engineered to deliver repeatable geometry for the loop opening 25, the gather ratio at the posterior hem, and the scallop height d relative to overall garment height c, while maintaining hand feel, drape, and durability under laundering.

Retrofit line design begins with receiving garments that possess the unmodified horizontal hem 28. Garments are sorted by fiber class and knit structure because cutting, heat sealing, and seam selection vary with fiber. Single-jersey cotton blends, polyester performance knits, and modal or rayon knits may all be processed, but blade selection and heat settings are tuned to avoid edge fray or melt. Each garment is placed on a standardized side-lay platen with registration pins that index the shoulder seam, side seam, and centerlines. The platen repeats a coordinate system so that cutline 34, cut pattern 36, and cutlines 38*a*/38*b*/42 and 40*a*/40*b* can be executed with millimetric repeatability.

For cutting, three interchangeable systems are contemplated. A steel-rule die set is mounted in a swing-arm press for high volume, low-capital installations. The die for cutline 34 employs a knife rule set into a plywood or aluminum backer with a relief radius at the side-seam tangent points to avoid nicking the seam. The die for cut pattern 36 integrates upper and lower blades that release the loop strip while leaving 10-15 mm uncut bridges at both lateral ends; these bridges are subsequently burst by a controlled pull to avoid over-cutting into the side-seam allowance and to maintain integral loop ends. For synthetics, laser cutting provides superior edge sealing; a galvo laser traces the vector paths of 34, 36, 38*a*, 38*b*, and 42 with power, speed, and frequency calibrated to produce a fused edge without significant hardening. Where thermal effects are undesirable (e.g., natural fibers), a CNC reciprocating knife with vacuum hold-down is preferred, employing fresh blades to produce clean edges with minimal fuzz.

Following cutting, the anterior retention loop 24 is formed by clearing the opening 25. If bridges were used, a guarded pull fixture grips the loop strip at the midspan and applies a controlled outward deflection to snap the bridges at the side regions, leaving the strip attached only at its ends. The strip is then conditioned with a light steam pass to relax any laser-induced curl. A loop-sizing jig verifies that the vertical spacing between the upper and lower boundaries of the released strip equals the design loop width (typically 10-50 mm). Dimensional tolerances of +2 mm are maintained to avoid pressure points during wear.

The posterior fabric gather 26 is established next. In a "resection and join" variant, a narrow rectangular section defined between 38*a* and 38*b* and bounded superiorly by 42 is removed. The resulting edges are overlapped by a predetermined amount corresponding to a posterior width reduction of 5-20% relative to the original back hem span. Overlap is secured by a lockstitch seam (ISO 301) with a bar-tack anchor at the lower hem and, if passing through the hem, a coverstitch (ISO 406) to restore hem elasticity. In a "butt-join over tape" variant, the edges are abutted and fused to a soft tricot tape applied on the inside using a heat-activated adhesive film, after which a zigzag topstitch secures the join while allowing controlled stretch. Both variants create a visible scrunch (gather) with a thickness profile that remains comfortable against the lower back.

Finishing of the scalloped front drape uses a curved-hem folder tuned to the specific curvature of cutline 34. For knits, a 10-12 mm double-turn hem finished with coverstitch preserves elasticity and minimizes tunneling. If mass is to be reduced, a narrow binding supplied from the same cloth ("self binding") can finish the edge. A hem-stability tape may be fused along the scallop apex to stabilize the curve. The relative drop d is verified with a template that references the neck opening 12 to accommodate size grading; acceptable ratios are typically $0.18 \le d/c \le 0.40$.

Large-scale retrofit lines benefit from fixtures that synchronize loop formation, gather joining, and hem finishing. A dual-station side-seam jig locates each garment by side seam and hem notch. The operator inserts the loop strip into a spring-loaded comb that holds it away from the front panel while sewing bar-tack reinforcements at the side-seam regions to prevent tear-out at the loop ends. While the garment remains clamped, the rear panel edges are overlapped along marks corresponding to 38*a*/38*b* and 42 and moved under a programmable feed bed that stitches the overlap in a single pass. Cycle time per garment using this integrated jig can be reduced below 150 seconds with two operators and one floater.

Materials and thread are selected to balance durability and hand feel. Tex 27-35 polyester thread is suitable for lockstitching on lightweight knits; for high-stretch jerseys, a textured polyester in the looper improves seam recovery. Needle selection is ball-point to avoid knit runs. Where thermal bonding is used (e.g., tricot tape at the gather join), a low-modulus adhesive with a melting point below the fabric scorch temperature is specified. All components must tolerate at least 30 domestic laundering cycles without stitch failure or significant change in loop length.

Quality assurance addresses geometry and function. A gauge block measures loop width at three positions; variation>2 mm triggers rework. A posterior gather tension test suspends a 1 kg mass from the back hem to confirm that the hem remains in contact with a standardized mandrel representing the lower back; an acceptable displacement criterion is less than 10 mm from the mandrel at midspan. The scallop is checked against a profile template; deviation of the apex location more than ±5 mm from nominal is rejected.

The retrofit process accommodates size ranges by scaling cut patterns. Length b, representing the lateral depth of the retention loop cut, is graded as a percentage of the original half-hem length a, commonly $0.25 \le b/a \le 0.45$. Because the loop 24 is integral and continuous, lateral span must permit engagement at the anterior waist without impinging on the iliac crest; ergonomic trials show span preferred between 60% and 85% of the distance between side-seam apexes on the front panel.

Purpose-designed, panel-based production avoids cutting away and discarding fabric to achieve the same functional results. In a first zero-waste embodiment, the anterior panel is drafted with an integral loop flap whose free edge tracks the curve of the future scallop. The flap is folded upward and topstitched at its lateral ends into the side-seam allowances, thereby creating the continuous loop 24 and the opening 25 without removing material. The scalloped hem is not trimmed; rather, the lower edge is the outer contour of the panel as cut from the marker. Because no fabric is removed, all material contributes either to the visible exterior or to the internal loop structure.

In a second zero-waste embodiment, a facing architecture is used. The anterior panel is cut with a crescent-shaped extension that, when folded behind, becomes a facing for the scalloped edge and simultaneously forms the loop tunnel. A first row of stitching secures the facing along the scallop; a second row closes the tunnel along a line corresponding to 40*a*/40*b*, creating the loop cavity and the opening 25. The extension's lateral terminations enter the side seams and are captured therein. The back panel incorporates a drafted dart system equivalent to cutlines 38*a*/38*b* and optional 42; the dart legs are sewn closed to create the posterior gather 26 without trimming. This approach yields a finished garment with zero trim waste attributable to the inventive features.

Panel cutting for the zero-waste systems is undertaken on multilayer spreaders with vacuum tables. Markers are engineered to nest the scallop curves and loop flaps to minimize inter-panel scrap. Registration notches coincide with the side-seam balance points to ensure loop ends align perfectly during assembly. Because the loop flap is internalized, fabric directionality is maintained to preserve stretch characteristics across the waist region, preventing unbalanced deformation during wear.

Assembly sequencing in panel-based production begins with forming the posterior gathers. Darts or eased seams are stitched at the back panel using programmable pattern tackers that control stitch length and tack geometry, yielding identical gather ratios across sizes. The anterior loop is then formed by folding the integral flap and topstitching at the side ends only, leaving the midspan free to define the opening 25. At this stage a temporary stay stitch may secure the loop in a flat orientation for subsequent handling; the stay stitch is later removed or covered by the front drape. Shoulder seams are joined, sleeves are set, and side seams are closed, deliberately capturing the loop ends and any facing extensions in those seams to maximize strength. The scalloped hem is finished last, using a curved-edge folder or fused seam tape as noted previously.

For both retrofit and panel-based lines, specialized guides increase throughput. A scallop-profile edge guide with adjustable cam followers rides the curved hem and maintains constant fold allowance into a coverstitch machine, ensuring uniform reveal along the scallop. A loop-forming spacer bar, temporarily inserted between the loop and the anterior panel during sewing, guarantees a consistent opening 25 height across sizes. A gather-forming clamp employing opposing contoured jaws draws the posterior edges together to a preset overlap before stitching, producing a stable scrunch with controlled bulk.

In-process ergonomics are also addressed. Because the anterior loop 24 is continuous and integral, lateral end loads concentrate at the side-seam regions during wear. Assembly procedures therefore specify bar-tack reinforcement across multiple thread passes at each end, oriented at 45 degrees relative to the seam line to distribute stress. Stitch density of 18-22 SPI (stitches per inch) is recommended for lockstitch reinforcement in jersey knits to balance strength and fabric damage risk.

Scaling to tens of thousands of units per week benefits from modular cells. A typical cell contains a cutting module (laser or knife), a loop-release and QC station, a gather stitching station, a hem finishing station, and a final assembly and inspection station. Work-in-process moves on hanger systems. Data capture at each station logs loop width, gather overlap, and hem profile against the garment ID to support traceability and continuous improvement. Statistical process control charts monitor d/c ratio and gather reduction percentage; corrective action triggers include out-of-control points or trends.

Laundering durability is validated using accelerated wash protocols. Loop length stability is measured after 5, 10, and 30 wash-dry cycles; acceptable growth is less than 3% relative to as-sewn length. Gather seam strength is tested by applying a cyclic tensile load representative of bending and reaching; the scrunch must resist seam slippage beyond 2 mm after 1,000 cycles. The scalloped hem is checked for tunneling and distortion.

Alternative materials and finishes are compatible with the disclosed manufacturing. The loop 24, being integral, inherits the mechanical properties of the anterior panel. To increase comfort, a soft brushed facing can be added over the loop on the wearer-facing side by bonding a microfleece strip with a low-temperature adhesive; this does not convert the loop into a separately affixed structural band, as the loop itself remains the integral fabric element. For moisture control, a perforation pattern can be die-cut into the loop strip midspan during retrofit using a micro-punch head, improving breathability without compromising continuity.

For uniforms and branding applications, logos may be applied to the front drape 22 without interfering with function. Transfer temperatures are limited to avoid inadvertently shrinking the loop region. If reflective tapes are added near the scallop, fusing is carried out before loop formation to avoid bonding the loop to the anterior panel.

The retrofit method can be adapted to woven shirts by substituting bias-cut loop segments. When the anterior panel has minimal inherent stretch, the integral loop 24 functions as a stable anchor; comfort is maintained by selecting the d/c ratio and b/a so that the front drape 22 provides sufficient slack. The posterior gather 26 in woven structures is preferably formed by a true dart sequence rather than overlap to minimize thickness; seams are then felled or bound to prevent irritation.

Safety and compliance are addressed by guarding the loop-release operation and extracting fumes during laser cutting. Operators are trained to verify that the loop 24 remains continuous after release and that no inadvertent cuts have severed the loop ends within the side-seam allowance. Any garment failing the continuity check is rejected because a non-continuous loop would not satisfy the integral loop limitation.

The foregoing manufacturing embodiments demonstrate that the invention can be implemented at scale across two orthogonal pathways: conversion of existing inventory with minimal new equipment and purpose-designed panel systems that eliminate fabric waste associated with forming the loop, the gather, and the scallop. In both pathways the anterior retention loop 24 remains a continuous, integral fabric component; the posterior fabric gather 26 provides the stay-down effect at the rear; and the front drape 22 with scalloped hem provides the intended aesthetic while concealing the internal structure.

Glossary of Claim Terms

Anterior retention loop means a continuous band portion formed of the same fabric body as the back panel and created as an integral structural element of the shirt rather than as an added strap or separately stitched component. In retrofit embodiments the loop 24 is defined by cutlines that isolate a continuous strip of the back panel while leaving its lateral ends intact at or near the side-seam regions, thereby forming a loop with a wearer-facing opening 25 between the strip and the remaining anterior fabric. In panel-based embodiments the loop is generated by folding or turning an integral flap along predetermined fold lines and securing only its ends to the side-seam regions, producing a closed loop that spans from the left side region to the right side region without crossing the posterior shirt face. The loop may be inelastic or slightly compliant depending on fabric selection, may be encased within a fabric tunnel formed by the anterior panel itself, and is configured to reside at the wearer's anterior waist or high-hip to act as an anchor that resists upward displacement of the posterior hem while permitting the front drape 22 to remain unconstrained.

Cut pattern for retention loop means the defined geometry in the back panel that isolates the material segment which becomes the continuous anterior retention loop 24. In retrofit work the cut pattern includes at least one upper boundary and one lower boundary generally parallel to the hem, and terminates laterally at regions proximate the side seams such that the loop ends remain integral with the garment body. The pattern yields a strip that, once freed from the surrounding material except at its ends, forms a closed loop spanning the anterior waist region and defining the opening 25 with the adjacent fabric. In panel-based embodiments 36 corresponds to a drafted flap or elongated tongue that is folded back upon itself to create the loop without removal of material; the same geometry can be laser-scored instead of cut to facilitate folding. The term excludes separately supplied straps or belts stitched onto the shirt.

Front drape with scalloped hem means the anterior lower portion of the garment that, in the finished article, hangs free from the abdomen and terminates in a non-linear concave profile defined by a smooth, continuous curvature that is lower at lateral regions near the side seams and rises toward a higher apex near the midline, or vice versa depending on style, thereby creating a scalloped appearance. The front drape 22 is integral with the anterior shirt face and is not structurally coupled to any waist-encircling belt, cord, or elastic. The scalloped edge is preferably formed along a predetermined scallop hem cutline 34 or, in panel-based embodiments, by pre-shaping the front panel to include the scallop as-cut without additional trimming. The term encompasses hems finished by folded coverstitching, binding, overedge stitching, heat-fused tape, or turned facings provided the resulting edge maintains the intended scallop geometry. The front drape is dimensioned so that its relaxed vertical drop (length d) relative to the original unmodified anterior hemline 30 is sufficient to drape over the anterior retention loop 24 and conceal it in the donned state while remaining free of circumferential tension, thereby permitting natural movement and an untucked aesthetic.

Lower left retention loop cutline means the left-side lower boundary of the cut pattern 36 that separates the loop strip from the anterior panel during retrofit. Cutline 40*a* typically runs generally parallel to the front hem and terminates within the left side-seam region so that the loop remains integral at that end. The vertical spacing between 40*a* and the corresponding upper boundary of the cut pattern sets the loop width. After executing 40*a*, the released loop strip is free from the anterior panel across the body except at the ends, thereby establishing part of the opening 25. In panel-based embodiments 40*a* corresponds to a foldline or topstitch line that closes a fabric tunnel forming the loop without removing material.

Lower right retention loop cutline means the right-side lower boundary complementary to 40*a* that completes separation of the loop strip from the anterior panel during retrofit while preserving the right-hand end's integral connection at the side region. The path of 40*b* is typically symmetric with 40*a*. Together with the upper boundary of the cut pattern 36, 40*a* and 40*b* define the vertical width and lateral span of the loop 24. In constructions that avoid cutting waste, 40*b* denotes the line along which the loop flap is folded or topstitched back onto the anterior panel to form a closed loop and the corresponding opening 25.

Opening of retention loop means the void space bounded on one side by the anterior retention loop 24 and on the other side by the inside surface of the anterior shirt face proximate the abdomen-facing region, through which the wearer's torso passes during donning such that the loop encircles the anterior waist. In cutline-formed embodiments the opening 25 is created when material above and/or below the loop strip is separated along cutlines and the loop remains attached only at its lateral ends, leaving a clearance gap sized to admit the wearer's body without excessive compression. In fold-formed embodiments the opening 25 is created by folding an integral flap to form a fabric tunnel, the tunnel interior constituting the opening. The opening is continuous across the anterior span between side regions and is dimensioned to maintain standoff sufficient to avoid abrasion yet small enough to maintain reliable engagement with the torso. The term encompasses openings that are partially bounded by facing pieces or seam allowances provided no separately affixed strap forms the loop.

Posterior fabric gather means a controlled reduction in the relaxed width of the posterior shirt face 18 proximate the lower hem effected by bringing together and joining separated posterior edges or by easing excess fabric onto a shorter internal anchor, thereby producing a localized ruche or scrunch that shortens the posterior hem span relative to the anterior. In retrofit embodiments the gather is formed by executing left and right gather cutlines (38*a*, 38*b*) and an optional top gather cutline 42 to define free edges that are then realigned and secured by stitching, thus removing effective width without requiring darts in the upper torso. In panel-based embodiments the gather is formed by pre-shaped darts, overlapped seams, or eased stitching along a predefined gather zone to achieve substantially the same effect. The gather 26 is positioned to maintain contact between the posterior lower edge and the wearer's lower back or hips during motion and may be distributed symmetrically or concentrated centrally. The term expressly includes a scrunch structure and is used interchangeably with scrunch and ruche herein.

Ruche means a localized gather or scrunch of fabric created by drawing a wider portion of material into a narrower span and securing the excess so that folds or pleats are formed. In the context of this invention, a ruche is functionally equivalent to the posterior fabric gather 26 and refers to the three-dimensional texture produced when posterior cutlines or darts are rejoined to shorten the back hem circumference relative to the front. A ruche may be formed by overlapping, darting, easing, or butt-joining fabric edges, with the result being a controlled reduction in effective fabric length along the posterior hemline 32. The term encompasses gathers that are symmetrical or asymmetrical, continuous across the midline or concentrated centrally, and expressly includes scrunch structures produced by knit contraction or sewn darts. As used herein, "ruche," "gather," and "scrunch" are interchangeable terms describing the structural modification of the posterior shirt face 18 that maintains contact of the rear lower edge with the wearer's waist or hips.

Scallop hem cutline means the planned, typically arcuate or spline-defined path across the anterior panel along which fabric is cut or along which a pattern piece is drafted to create the scalloped front drape 22. In retrofit embodiments cutline 34 is plotted relative to the unmodified anterior hemline 30 such that the apex of the scallop reaches a predetermined height d above or below 30, with smooth tangency into the side regions to avoid stress concentrations. In panel-based embodiments the cutline is embodied directly in the front panel's outer contour, eliminating trimming waste. Cutline 34 can be executed by laser cutting, steel-rule dies, rotary blades, or manual shears and is subsequently finished by hemming, binding, or fusing to stabilize the edge. The geometry of 34 is selected to conceal the anterior retention loop 24 in the donned state while permitting sufficient sweep to maintain aesthetic drape.

Top gather cutline means an optional upper boundary in the posterior panel used to control the vertical extent and distribution of the posterior fabric gather 26. When present in retrofit processes, cutline 42 intersects or joins the upper ends of cutlines 38*a* and 38*b*, producing a three-sided opening whose closure by overlapping or by inserting a short bridging piece concentrates the scrunch near the center back and spreads strain over a larger vertical area. In panel-based constructions 42 corresponds to a dart apex or eased-in length that is stitched closed to form an invisible gather without trimming. The use of 42 enables predictable gather ratios and provides a mechanical stop for machines and jigs in high-throughput assembly, improving consistency of the posterior reduction while maintaining fabric hand and comfort.

Unmodified anterior hemline means the portion of the unmodified horizontal hem 28 that corresponds to the anterior shirt face 16 prior to scallop formation. It is a reference baseline used to quantify the magnitude of the scallop (length d) and to position cutline 34 in retrofit embodiments. The term encompasses hems that may have a slight curvature common to many tees and jerseys. During modification, the unmodified anterior hemline 30 is replaced by the scalloped hem of the front drape 22; however, 30 remains a useful datum for calculating proportional relationships such as d/c and for locating the anterior retention loop 24 vertically relative to the finished hem. In panel-based construction, the concept of 30 persists as the pattern-drafting line representing the anterior edge before the scallop contour is drafted, and may be marked on the pattern but not cut as a final edge.

Unmodified horizontal hem means the original, as-manufactured continuous bottom edge of an off-the-shelf shirt prior to any of the modifications described, the edge typically being a substantially straight or gently curved line when the garment is laid flat. In the context of retrofitting, hem 28 provides the baseline from which dimensional parameters are taken, including the original half-perimeter sometimes denoted length a. The unmodified hem includes both the unmodified anterior hemline 30 and the unmodified posterior hemline 32. The term is used to distinguish the starting condition from the scalloped hem resulting after modification; it does not require that the original hem be perfectly linear or planar, only that it has not yet been reshaped by the disclosed cutlines or panel operations. For woven or knit shirts, hem 28 may be finished by a coverstitch, overedge/overlock, or turned hem. Measurements of drop, rise, and gather ratios are referenced to hem 28 unless otherwise specified.

Unmodified posterior hemline means the original lower edge of the posterior shirt face 18 prior to implementing the posterior fabric gather 26. It serves as a reference for determining the amount of width reduction required to obtain the desired gather ratio and for locating gather cutlines 38*a*, 38*b*, and optional 42. In retrofit operations the unmodified posterior hemline 32 is often partially opened to form a tunnel or to accommodate resection and rejoining of the back panel; in panel-based operations 32 is replaced by a shortened, eased, or darted configuration integral to the back panel piece. Dimensional comparisons between the finished posterior hem and the unmodified posterior hemline 32 quantify the asymmetric tension profile that keeps the back in abutment with the wearer while the front remains free.

Upper left gather cutline means the left-hand boundary of a posterior resection or overlap used to obtain the posterior fabric gather 26 in retrofit embodiments. Cutline 38*a* is typically oriented generally vertical or slightly canted relative to the hem and is paired with an opposing cutline 38*b*. The distance between 38*a* and 38*b* defines the material width that will be eliminated or overlapped to reduce the posterior hem span. The edge created by 38*a* is subsequently brought toward the midline and joined to a corresponding edge created by 38*b*, optionally with the assistance of a top gather cutline 42 to control the distribution of the ruche. Stitching types suitable for rejoining include lockstitch (ISO 301) with bar-tack reinforcement or coverstitch (ISO 406) if the join crosses a hem.

Upper right gather cutline means the right-hand boundary counterpart to 38*a* and together with 38*a* defines the posterior segment that will be removed, overlapped, or eased to achieve the gather 26. The geometry of 38*b* may mirror 38*a* or be independently shaped to bias the gather toward the center back. After cutting, the edges defined by 38*a* and 38*b* are aligned and joined, or they are overlapped under a reinforcing strip, thereby creating a scrunch that shortens the posterior hem circumference relative to the anterior. In some embodiments the edges at 38*a* and 38*b* are not fully knife-cut; instead, they are laser-scored or perforated and torn to generate a soft edge suitable for blending into knit structures.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

All numerical designations, such as measurements, efficacies, physical characteristics, forces, and other designations, including ranges, are approximations which are varied up or down by increments of 1.0 or 0.1, as appropriate. It is to be understood, even if it is not always explicitly stated that all numerical designations are preceded by the term "approximately." As used herein, "approximately" refers to being within an acceptable error range for the particular value as determined by one of ordinary skill in the art, which will depend in part on how the value is measured or determined. When an acceptable range is not dictated by the one of ordinary skill in the art, "approximately" refers to ±15% of the numerical when used in connection with particular values; it should be understood that a numerical including an associated range with a lower boundary of greater than zero must be a non-zero numerical, and the term "approximately" should be understood to include only non-zero values in such scenarios.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An upper-body garment comprising:

a. a front panel and a back panel joined at left and right side regions, the front panel terminating in a front drape having a scalloped hem;

b. a continuous anterior retention loop formed integrally from the back panel by cutlines that isolate an elongated strip of the back panel while leaving the strip attached only within the left and right side regions, the strip being turned from a posterior orientation to an anterior interior orientation to lie along an interior surface of the front panel and to cooperate with the front panel to define a wearer-facing loop opening; and c. a posterior fabric gather in the back panel that reduces a relaxed width of a posterior hem, wherein in a donned state the loop engages an anterior waist of a wearer while the posterior fabric gather maintains a rear lower edge in contact with the wearer and the front drape hangs freely and wherein the garment is free of any separately affixed strap or belt that forms the loop.

2. The garment of claim 1, wherein the cutlines comprise upper and lower boundaries parallel to the posterior hem and lateral terminations within the left and right side regions so that both ends of the loop remain integral with the back panel and are captured by side-region stitching.

3. The garment of claim 1, wherein the turning of the loop from posterior to anterior interior is effected through pass-through notches or side-region openings formed in seam allowances prior to side-region closure, the loop thereafter lying along the interior of the front panel.

4. The garment of claim 1, wherein the posterior fabric gather is produced by executing left and right gather cutlines and rejoining edges thereby created to remove effective posterior width by 5%-20% relative to an unmodified posterior hem span.

5. The garment of claim 1, wherein a ratio of scallop height to overall garment height is 0.18-0.40, and the front drape is dimensioned to conceal the loop in the donned state.

6. The garment of claim 1, wherein a lateral span of the loop between the side regions is 60%-85% of a distance between side-region apexes of the front panel, and a loop width measured vertically is 10-50 mm.

7. The garment of claim 1, wherein the loop is received within a fabric tunnel formed on the anterior interior, the tunnel being formed from the front panel or a facing fixed thereto, while the structural loop element remains the integral strip of the back panel.

8. The garment of claim 1, wherein the posterior fabric gather comprises a gather structure selected from the group consisting of an overlapped seam, a buttjoined seam over an interior tape, and closed darts, the gather structure being disposed along a center back region of the back panel and reinforced at the hem by a coverstitch.

* * * * *